US006276068B1

(12) United States Patent
Sheliga

(10) Patent No.: US 6,276,068 B1
(45) Date of Patent: Aug. 21, 2001

(54) ARCHERY SIGHT WITH ZERO PIN SPACING CAPABILITY

(76) Inventor: Douglas J. Sheliga, 11950 Taylor Wells Rd., Chardon, OH (US) 44024

( * ) Notice: Subject to any disclaimer, the term of this patent is extended or adjusted under 35 U.S.C. 154(b) by 0 days.

(21) Appl. No.: 09/491,620

(22) Filed: Jan. 26, 2000

(51) Int. Cl.[7] ..... F41G 1/467
(52) U.S. Cl. ..... 33/265; 124/87
(58) Field of Search ..... 33/265; 124/87

(56) References Cited

U.S. PATENT DOCUMENTS

| | | | | |
|---|---|---|---|---|
| 3,475,820 | * | 11/1969 | Kernan | 33/265 |
| 4,999,919 | * | 3/1991 | Sparkman | 33/265 |
| 5,050,576 | | 9/1991 | Larson | 124/87 |
| 5,094,002 | * | 3/1992 | Saunders | 33/265 |
| 5,103,568 | * | 4/1992 | Canoy | 33/265 |
| 5,165,178 | | 11/1992 | Seely | 33/265 |
| 5,220,907 | | 6/1993 | Lonsdale | 124/87 |
| 5,239,760 | | 8/1993 | Dixon et al. | 33/267 |
| 5,406,712 | * | 4/1995 | Slates | 33/265 |
| 5,419,051 | | 5/1995 | Barngrover | 33/265 |
| 5,676,122 | | 10/1997 | Wiseby et al. | 124/87 |
| 5,685,081 | * | 11/1997 | Winegar | 33/265 |

* cited by examiner

*Primary Examiner*—Diego Gutierrez
*Assistant Examiner*—Madeline Gonzalez

(57) ABSTRACT

An Archery Sight with Zero Pin Spacing Capability consisting of a mounting assembly and a fixed pin assembly. The fixed pin assembly consists of channel containing a plurality of horizontal sight pins each mounted to a vertical support. The stack of the plurality of vertical supports are held rigid by friction from a compression force from screws positioned through the sides of a channel. The sight pin vertical supports may be separated by separating components that are fixed in the vertical direction so that moving one sight pin does not affect other sight pins. The sight pins are moved by finger pressure or by adjusting screw when the compression force is released by loosening other screws. With the above configuration, the pins may be moved so that they touch one another. The fixed pin assembly can be adjusted horizontally and vertically by means in the mounting assembly.

4 Claims, 7 Drawing Sheets

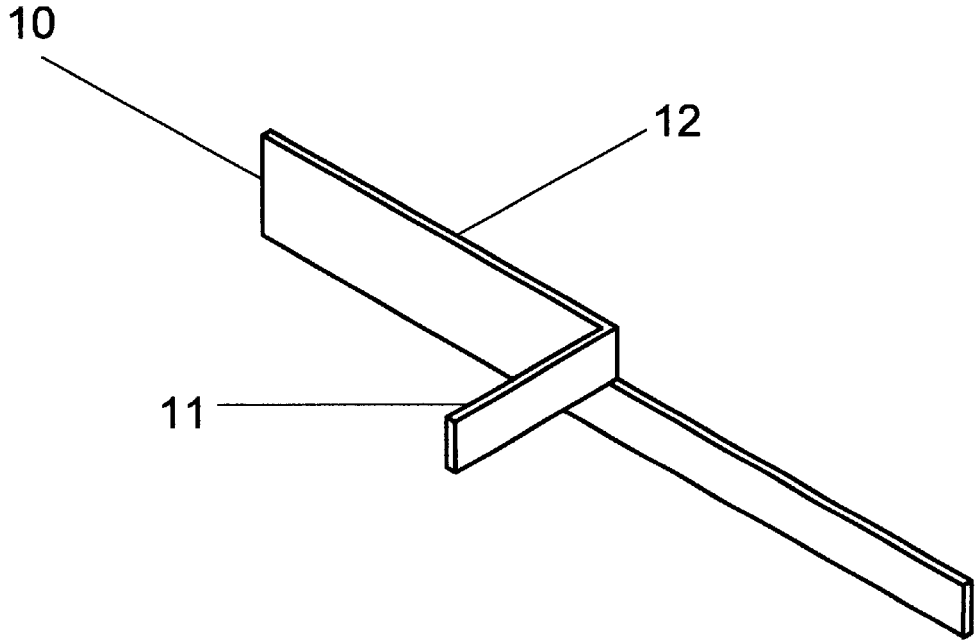
FIG. 1-A
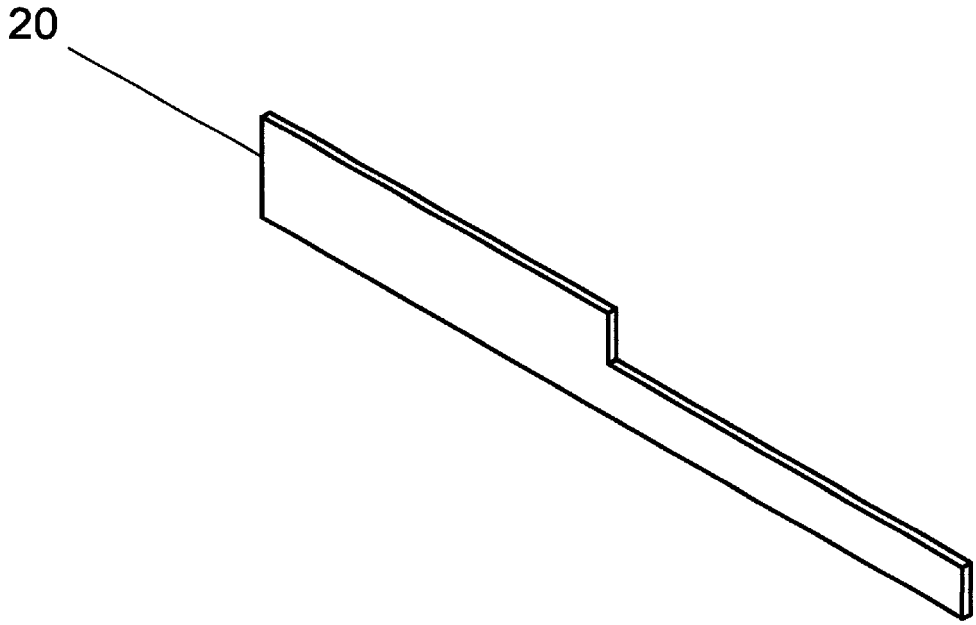
FIG. 1-B

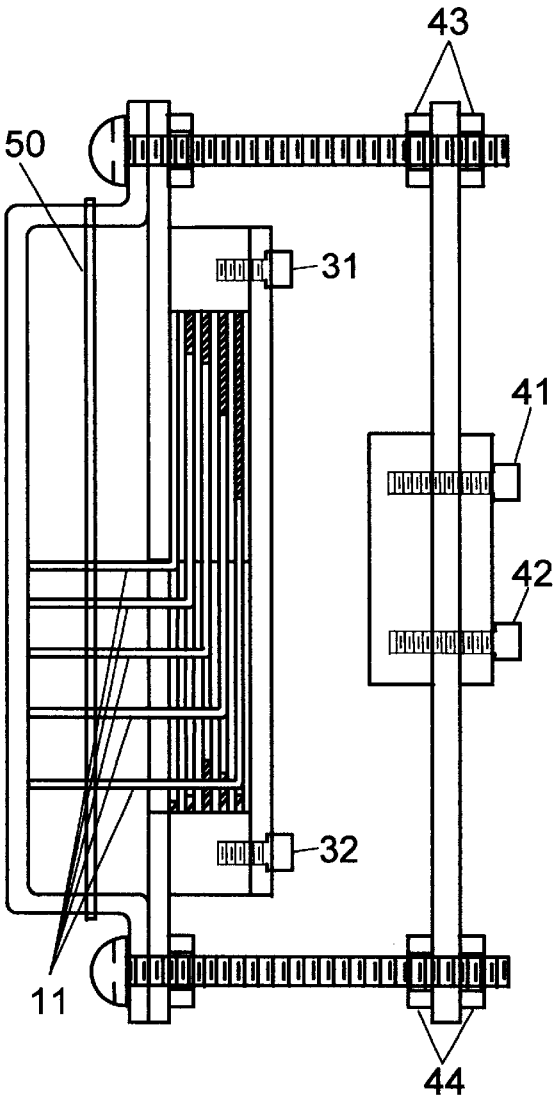
FIG. 5-A
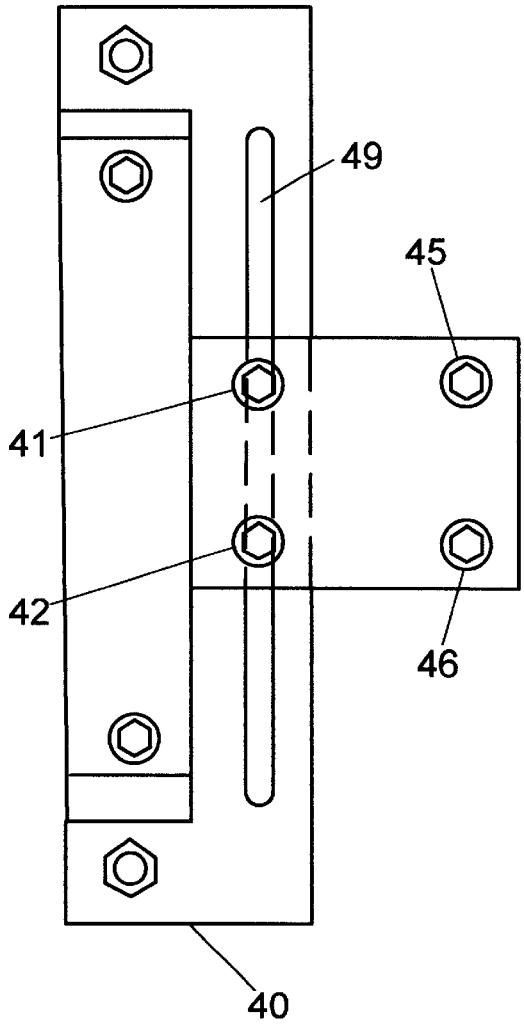
FIG. 5-B

ARCHERY SIGHT WITH ZERO PIN SPACING CAPABILITY

BACKGROUND OF THE INVENTION (1) Field of Invention

This invention relates to archery. It relates to a component on the archery bow. Most specifically, it relates to a unique class of archery sight called fixed pins. The sight pins are horizontal members on the sight. They are used by the archer to gauge distance. Fixed pins means that an archer has preset the pins by trial and error on the practice range then no longer changes them. As an example, if the archer has four pins set to maybe four different yardages, say 20, 30, 40 and 50 yards, he will use the pins to gauge yardages within that range. Fixed pins are used by the hunting archer so that the archer doesn't have to take the time to adjust the sight before the shot.

(2) Description of Prior Art

Available today are many types of fixed pin archery sights. All of them have some unique characteristic. However, there has been an ongoing problem with fixed pin archery sights since their inception. That problem is that the pins cannot be positioned close enough to each other in an aesthetic manner.

There have been four solutions. First, is construct the sight like two, that is, to put one sight behind the other so that the pins of one can fill in the gaps of the other to get the pins close. This sight is not aesthetically pleasing. Second, is to mount the sight as far forward the bow as possible to get the sight farther from the archers eye resulting in the needed farther pin spacing. Third, is to angle the pins so the middle one may be horizontal but the upper ones are angled down so that they may come close to the middle one and likewise, the lower ones are angled up resulting in a not so nice looking array. Fourth is to tilt forward or backward the array of horizontal pins like looking up or down at the rungs of a ladder so they appear closer together.

This problem has always existed. And now, with new technology, bow speeds have increased resulting in the need for even closer pin spacing.

See attachment A for comments on related existing patents, listed on PTO-1449 "List of prior art cited by applicant". To summarize the comments, the applicant's idea is unique, none of the existing patents are the same. The applicant's invention is better because it overcomes the above problem.

SUMMARY OF INVENTION

The Archery Sight with Zero Pin Spacing Capability (ASZPSC) belongs to the class of sights call fixed pins. The ASZPSC has a unique quality that other sight do not have. The pins can be adjusted so close that they can touch each other. And this is done in an aesthetic manner, that is all pins are horizontal and in the same plane. No other sight can do this as simple a manner. One complicated version that can is U.S. Pat. No. 5,239,760 by Dixon et al. Of course no one would adjust the pins so they are touching but, this does illustrate the ASZPSC capabilities. When the archer mounts the sight close to the bow the pins need to be adjusted close together which is unachievable by most other sights.

The author has been thinking of a way to make this sight for probably more than ten years. He has built and tested an acceptable sight.

To summarize the benefit, no matter where the sight is mounted, the pins will be adjustable to any spacing desired and appear aesthetically pleasing. This orderly effect is desired by the archer who enjoys a totally organized environment to do precision shooting.

BRIEF DESCRIPTION OF THE DRAWINGS

The following nine figures are attached.

FIGS. 1A and 1B respectively show a sighting component 10 and a separating component 20.

FIGS. 5-A and 5-B respectively show the front and side views of the same assembly of FIG. 3 and a typical mounting assembly 40 for an archery bow. The figures also show the adjustments that can be made to the assemblies.

DESCRIPTION OF THE PREFERRED EMBODIMENT(S)

Figure 2:
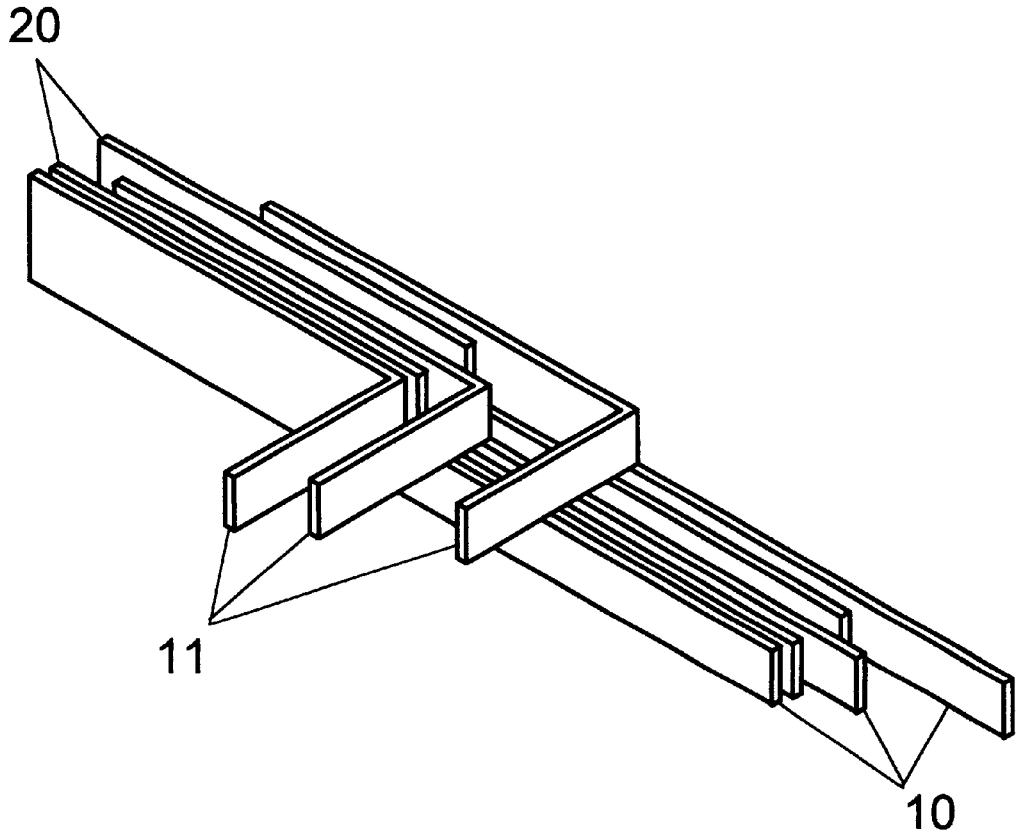
FIG. 2 shows how the sighting components 10 and separating components 20 fit together.

The following are the designations of the preferred embodiments.

10 sighting component
11 sight pin
12 support bar
20 separating component
30 channel
31 & 32 screws to lock sighting components
40 mounting assembly
41 & 42 screws for vertical adjustment for channel
43 & 44 nuts for horizontal adjustment of channel
45 & 46 screws to mount to bow
49 slot for vertical adjustment of channel
50 vertical aiming member
60 alternative sighting component
61 sight pin
64 & 65 screws to lock sighting components
66 vertical adjustment screw for alternative sighting component The operation can be explained from the following figures.

FIG. 1-A shows a sighting component 10. The sighting component 10 consists of a sight pin 11 and the part perpendicular to it called the support bar 12. A complete sight can be made with any number of sighting components, typically four or five. The sighting component 10 is shown to be made from a flat piece of material. Typically the material thickness is 0.05 inch or less. Archers with better vision can use thinner sight pins. The thin edge of the sight pin 11 is used for aiming. The edge may be colored orange, or other acceptable color. The sight pins 11 could just as well be round ones that are permanently attached (such as spot welded) to the support bars 12.

FIG. 1-B shows a separating component 20. It is used between sighting components 10 so adjacent sighting components 10 do not move when the adjustment of one sighting component 10 is made.

FIG. 2 shows how the sighting components 10 and separating components 20 fit together. The lengths of the sighting components 10, the lengths of the sight pins 11 and the lengths of the separating components 20 are not all the same in the configuration. The components need to be manufactured in various lengths to fit in the assembly described below.

Figure 3:
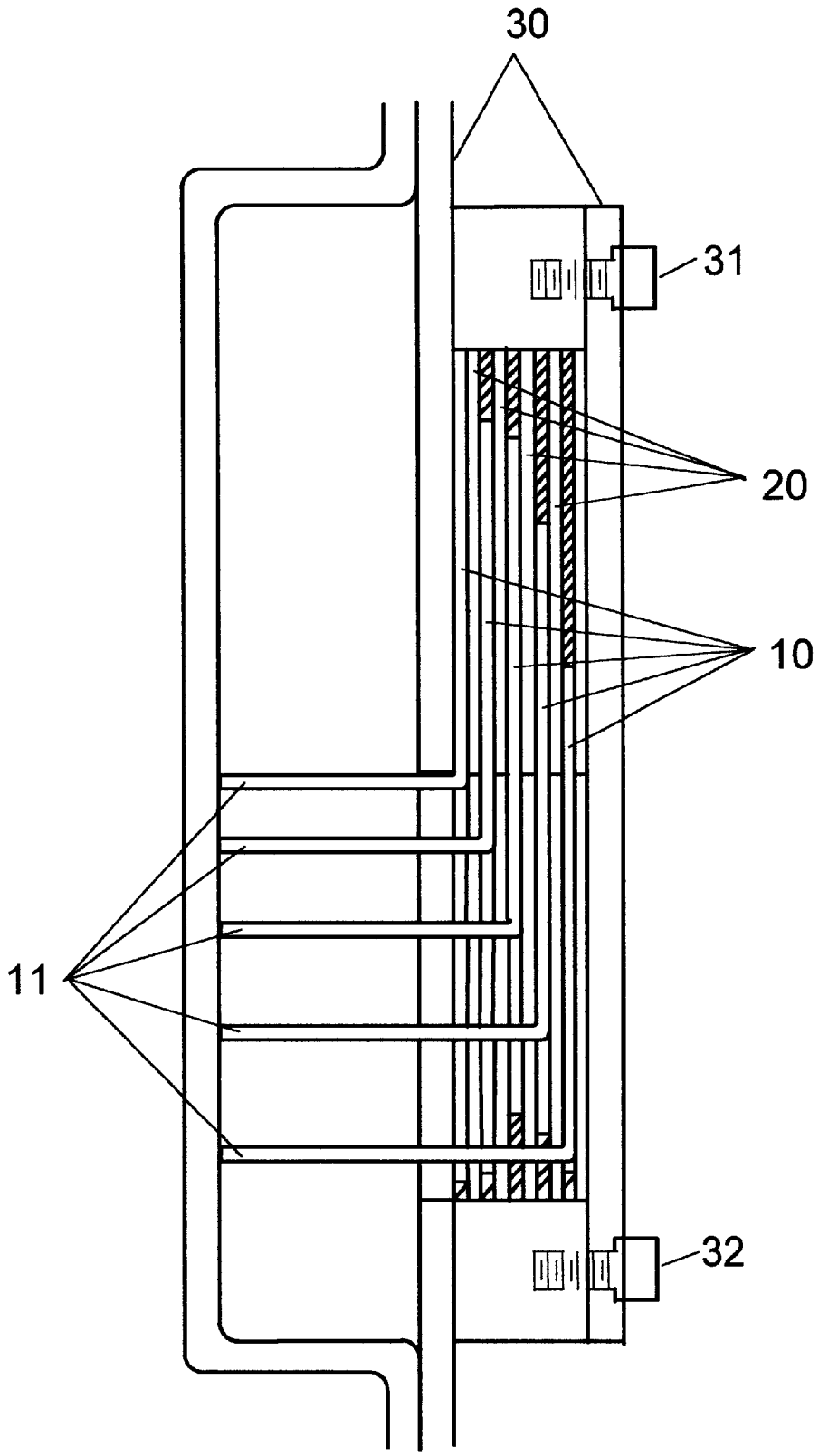
FIG. 3 shows the sighting components 10 and separating components 20 arranged in an assembly. The sight pins 11 are spaced apart as they would be realistically arranged for actual use.

FIG. 3 shows an assembly of the above components. The sighting components 10 and the separating components 20 are stacked in a channel 30. The separating components 20 cannot be moved up and down because they are in direct contact at their top and bottom with other parts of the assembly. The sighting components 10 can slide up and down for adjustment.

Said channel 30 is actually made of two pieces of angle. The left side of the assembly and the side behind the sighting components 10 and separating components 20 is one piece of angle. The right side, thru which screws 31 and 32 tighten the assembly, and a cover (not shown) make up the second piece of angle. The cover, portion that would cover the whole assembly, is intentionally left off so the inside of the assembly can be seen.

The sighting components 10 are locked in place when the side screws 31 and 32 are tightened. There is a compressional force on the sighting components 10 and separating components 20 as the screws 31 and 32 are tightened. The compressional force is possible because the width of the stacked sighting components 10 and separating components 20 is slightly greater than the space provided.

The adjustment of the sight pins 11 are made by loosening screws 31 and 32. The sight pins 11 are slid up and down as needed. When sight pins 11 are in proper position, the screws 31 and 32 are retightened.

The sight pins 11 need be adjusted only once each at specified distance on the practice range. Then the relationship between the sight pins 11 for the set distances is fixed and should not change. Screws 31 and 32 are then tightened. Subsequent vertical and horizontal adjustments of the entire assembly of sighting components are made by other adjustments explained in FIGS. 5-A and 5-B.

Figure 4:
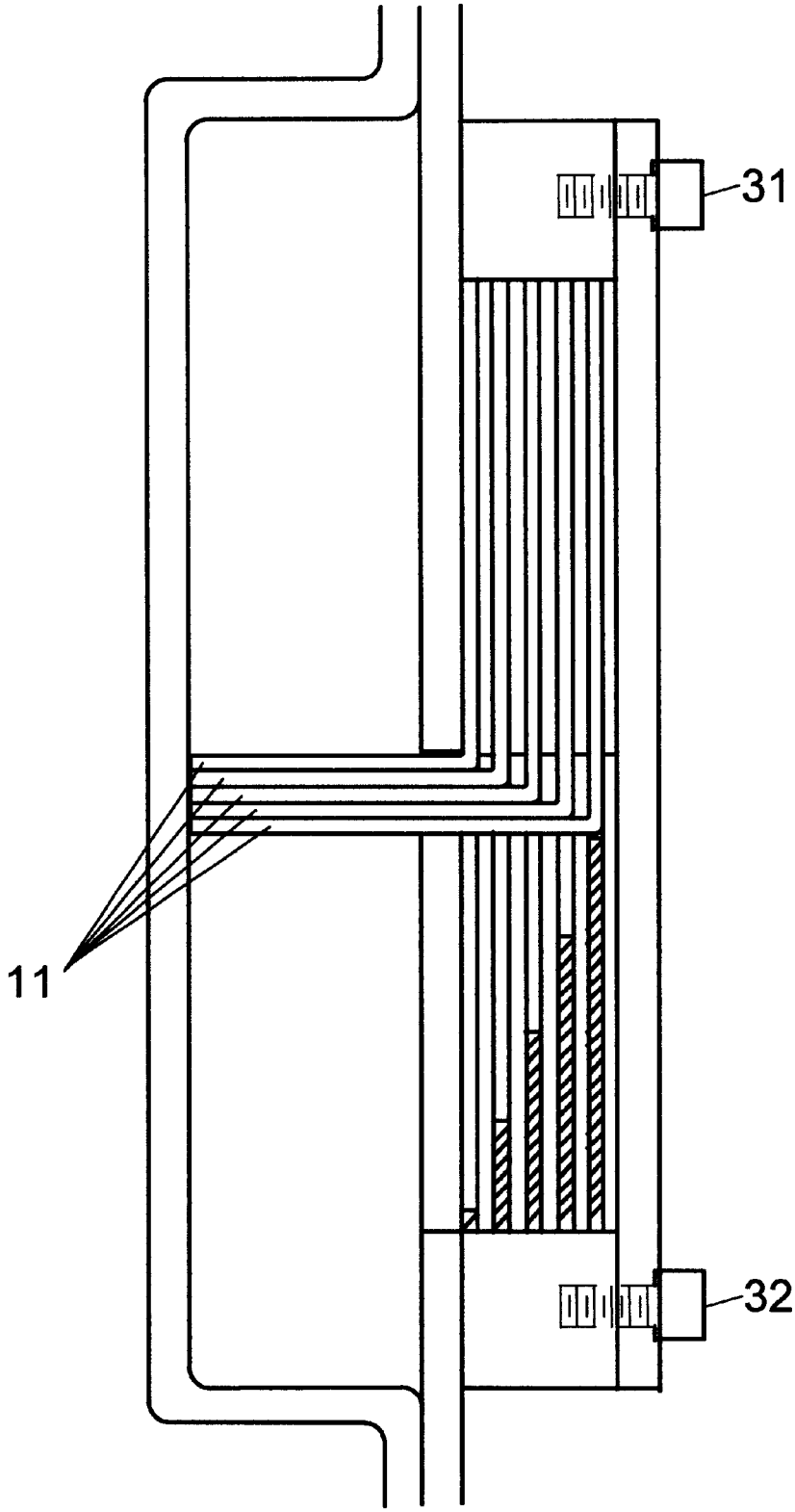
FIG. 4 shows the same as FIG. 3 except the sight pins 11 are touching to illustrate how close they can be adjusted.

FIG. 4 shows the extreme with the sight pins 12 touching each other. Most other sights cannot do this.

FIGS. 5-A and 5B show the mounting assembly 40 and one of many methods of vertical and horizontal adjustment. Vertical adjustment is made by loosening screws 41 and 42 and moving the resultant assembly up and down in the slot 49. Horizontal adjustment is made by adjusting nuts 43 and 44.

Note a vertical aiming member 50 has been added to FIG. 5-A. The vertical member 50 and the horizontal sight pins 11 form aiming cross hairs. For example, if the top sight pin 11 is set for 20 yards, then the cross hairs composed of it and the vertical aiming 50 member will be held directly on the target by the archer as the arrow is shot so the 20 yard target can be accurately hit by the arrow.

Figure 6:
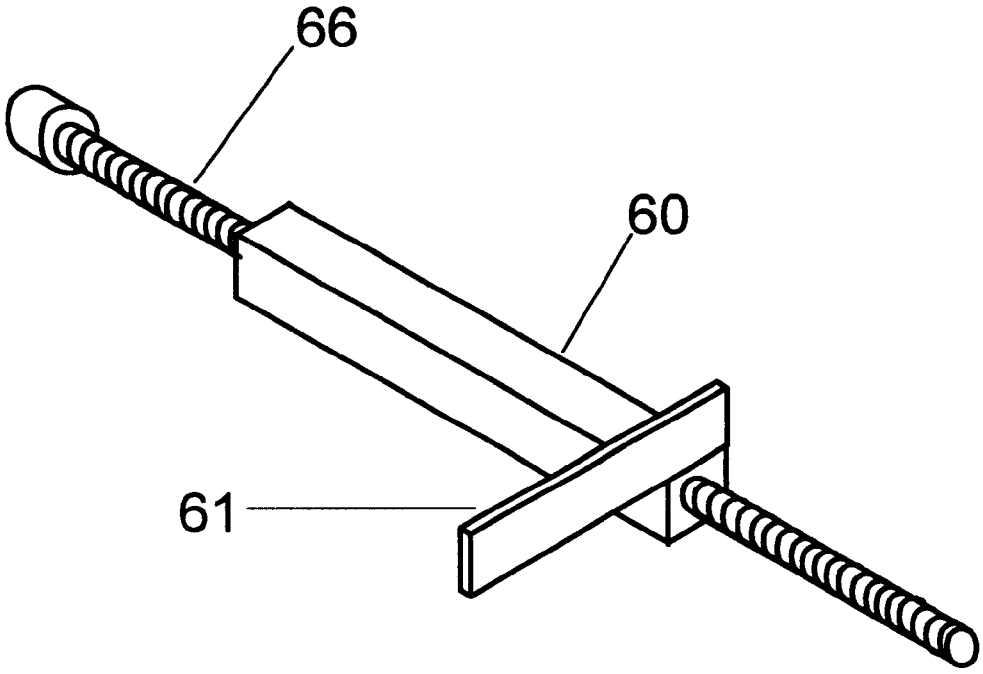
FIG. 6 shows an alternative sighting component 60 with an adjusting screw 66.

FIG. 6 shows an alternative sighting component 60. The previous sighting component 10 is manually pushed up and down after loosening screws 31 and 32. The alternative sighting component 60 has a screw 66 thru the middle as shown. As the screw 66 is turned in the assembly, the sight pin 61 moves up and down. The sight pin 61 can be a flat or round material as previously discussed.

Figure 7:
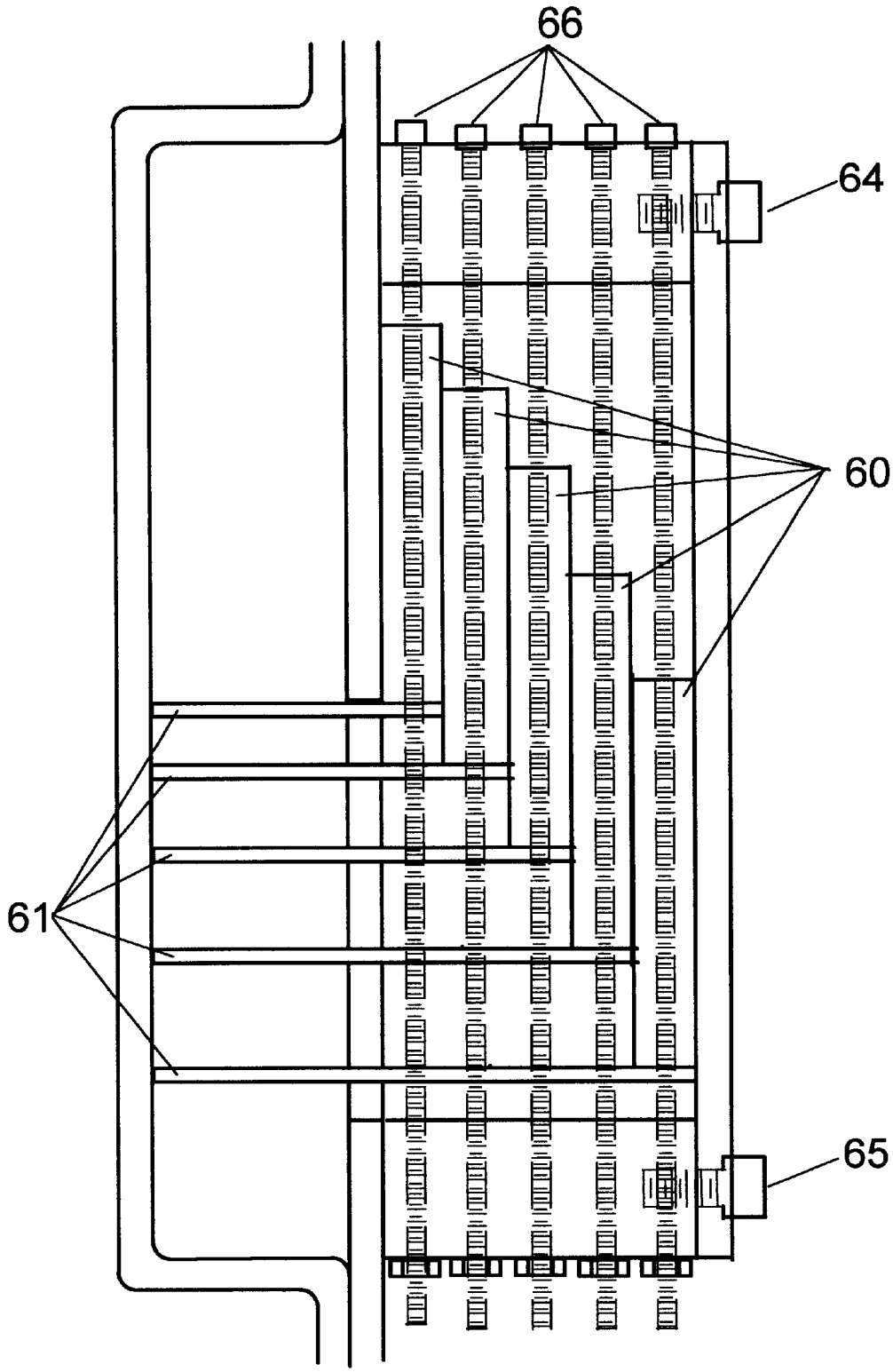
FIG. 7 shows an assembly of alternative sighting components 60. It shows the configuration of sight pins 61 and their adjustable screws 66.

FIG. 7 shows an assembly of five sighting components 60. As the screws 66 are turned, the sight pins 61 move up and down, then they can be locked in place using screws 64 and 65. Screws 64 and 65 apply a compressional force on the sighting components 60 because their width is slightly greater than the space provided.

A ramification of ASZPSC is a reduction of error caused by the archer inadvertently torquing the bow. This advantage is achieved when the sight is mounted directly above the arrow rest. This means that as the bow is torqued, the sight does not change position with respect to the tip of the arrow. Other bows with the sight mounted six inches in front and the rest mounted two inches behind allow the sight to move in one direction and the arrow in the other direction as the bow is torqued. The result, of course, is an errant shot. The close pin spacing allows the sight to be mounted on the archer side of the bow.

Another ramification is that the aiming edges of the sight pins are flat surfaces unlike the round pins that are normally used in other sights. The advantage here is that lighting does not interfere with the sight. The lighting of the upper edge or lower edges of a round sight pin can cause the archer to aim a little high or a little low. There are alternate configurations of the sighting component. The sight pin is shown to be an integral part of the sighting component. However the sight pin may in fact be a separate piece of material of a different shape fastened to the support bar. The sight pin could be a round pin if desired.

Another ramification is that the ASZPSC may be used without a peep. The sight portion to the side of the sight window can be used to install a reference mark to align with a mark on the bow string. As an example, the reference mark may be a white square. The archer will vertically bisect the white square with the string and put the mark on the string directly below the white square.

A final ramification is that the ASZPSC is of simple construction making it commercially viable.

What is claimed is:

1. A sight for use with an archery bow comprising:

a mounting member attachable to said bow, said mounting member supporting a sighting assembly and means of adjusting said sighting assembly in a horizontal and vertical direction, said sighting assembly consisting of a channel containing a plurality of sighting components and separating components as needed, said channel with means of compression force to hold rigid a plurality of said sighting components and said separating components as needed.

said sighting components each consisting of a sight pin rigidly attached to and perpendicular to a support bar, wherein a description of said support bar and said sight pin are respectively a vertical and a horizontal portion of an "L" shape, wherein a plurality of said "L" shapes can be configured in a stack such that said vertical portions are side by side and said horizontal portions are above and below each other, wherein said vertical portions can stay in contact while said horizontal portions are moved and spaced vertically, said description illustrating how said support bars are able to be stacked and said sight pins are vertically adjustable.

said separating components shaped similar to said support bars and positioned between said sighting components in a stack configuration, said separating component shape does not interfere with the movement of said sighting components.

said stack consisting of said separating components held fixed in vertical position in said channel and said sighting components capable of individual vertical movement between said separating components, said movement possible when said means of compression force of said channel is removed and done without affecting the position of other said sighting components.

2. The means to adjust the sighting assembly of claim 1 wherein said means to adjust in the horizontal and vertical direction can be any of a multitude of existing methods.

3. The means of compression force of claim 1 wherein said means to compress the plurality of sighting components and separating components consists of the channel, composed of two pieces, one on each side of the plurality of components, tightened by fasteners.

4. The sighting assembly of claim 1 wherein a cross hair perpendicular to the sight pins and positioned in front or behind the sight pins capable of providing horizontal reference for sighting or wherein the sight pins may contain distinguishable colors and shapes at their ends for the said horizontal reference, and wherein a combination of said references and said sight pins become an aiming sight for an archer.

* * * * *